US007536934B1

(12) United States Patent
Tatangelo

(10) Patent No.: US 7,536,934 B1
(45) Date of Patent: May 26, 2009

(54) RATCHET TOOL

(75) Inventor: Stephen Michael Tatangelo, Grand Blanc, MI (US)

(73) Assignee: Sears Brands, LLC., Hoffman Estates, IL (US)

( * ) Notice: Subject to any disclaimer, the term of this patent is extended or adjusted under 35 U.S.C. 154(b) by 0 days.

(21) Appl. No.: 12/046,219

(22) Filed: Mar. 11, 2008

(51) Int. Cl.
*B25B 13/46* (2006.01)
*B25B 17/00* (2006.01)

(52) U.S. Cl. ..... 81/60; 81/62; 81/57.22

(58) Field of Classification Search ..... 81/60–63.2, 81/57.22, 57.29, 57.3, 58.1, 57.31
See application file for complete search history.

(56) References Cited

U.S. PATENT DOCUMENTS 1,860,914 A * 5/1932 Wellman ..... 81/57.31
2,520,443 A * 8/1950 Seaquist ..... 81/58.1
3,983,759 A 10/1976 Linden
4,366,731 A 1/1983 Vallevand
4,770,071 A * 9/1988 Steier ..... 81/63
5,009,132 A 4/1991 Gilberto
5,058,463 A * 10/1991 Wannop ..... 81/57.29
5,105,688 A * 4/1992 Williams, III ..... 81/57.31
7,168,340 B1 * 1/2007 Green ..... 81/57.3
2003/0213341 A1 * 11/2003 Alden ..... 81/57.29

* cited by examiner

*Primary Examiner*—Hadi Shakeri
(74) *Attorney, Agent, or Firm*—Greenberg Traurig LLP

(57) ABSTRACT

A ratchet tool is provided. The ratchet tool includes a body having a head and an elongated handle. A gear train and pawl assembly are contained within the head of the body. A switching mechanism also extends into the head of the body and interacts with the pawl assembly. The arrangement and interaction of the body, gear train, pawl assembly and switching mechanism provides for transmission of torque from the ratchet tool in a single direction when the handle is rotated both in clockwise and counterclockwise directions.

17 Claims, 12 Drawing Sheets

RATCHET TOOL

FIELD

The present disclosure relates to hand tools, and, more particularly, ratchet tools such as wrenches.

BACKGROUND

Hand tools such as ratchet wrenches are well known. In particular, multiple wrenches which convert reciprocating motion into a perpetual positive drive are known. For example, U.S. Pat. No. 3,983,759 to Linden discloses a wrench which provides a positive drive from reciprocating handle motion through the use of a dual handle body and a reversing gear system. In another example, U.S. Pat. No. 4,366,731 to Vallevand discloses a wrench with similar functionality through the use of dual handles and a pair of ratcheting mechanisms. Another example, U.S. Pat. No. 5,009,132 to Gilberto, discloses a wrench which converts reciprocating motion into a perpetual positive drive via the use of a pair of spaced housings which are rigidly attached to a socket drive and separated by a third intermediate housing containing an internal planetary gear system. In yet another example, US Patent Application Publication No. 2003/0213341 to Alden discloses a wrench which provides a positive drive from reciprocating handle motion through the use of a gear system and a set of pawls which engage with the gear system. As such tools continue to be used in a variety of applications, their continued development is desirable.

SUMMARY

The present disclosure provides a ratchet tool. The ratchet tool includes a body having a head and a handle. The head has a cavity formed therein and an axis defined therethrough. The handle has an end fixed relative to the head and defines a length extending away from the head. The handle is oriented with the length substantially perpendicular to the axis.

The ratchet tool further includes a gear train disposed within the cavity. The gear train includes first and second gears pivotally supported about the axis and a gear coupling disposed between the first and second gears. The gear coupling transmits rotation of one of the first and second gears to an opposite rotation of the other of the first and second gears. The ratchet tool also includes a socket drive fixed relative to the second gear and extending outside of the head.

The ratchet tool further includes a pawl assembly disposed within the cavity outside of the gear train. The pawl assembly includes a first pawl adapted to mesh with the first gear and a second pawl adapted to mesh with the second gear. The pawl assembly further includes a pivot member and a pair of push arms disposed between the first and second pawls. The push arms pivotally couple the first and second pawls about the pivot member.

The pawl assembly is movable between first and second configurations. The first configuration includes the first pawl pivoted into engagement with the first gear and the second pawl correspondingly pivoted away from the second gear. The second configuration includes the second pawl pivoted into engagement with the second gear and the first pawl correspondingly pivoted away from the first gear.

The ratchet tool also includes a switching mechanism extending into the cavity and engaging the pawl assembly. The switching mechanism is selectively fixed in a first position relative to the body. The switching mechanism applies a first force to the pawl assembly to move the pawl assembly to the first configuration when the handle is rotated about the axis in a first direction. The switching mechanism applies a second force to the pawl assembly to move the pawl assembly to the second configuration when the handle is rotated about the axis in a second direction opposite to the first direction.

DETAILED DESCRIPTION

Figure 1A:
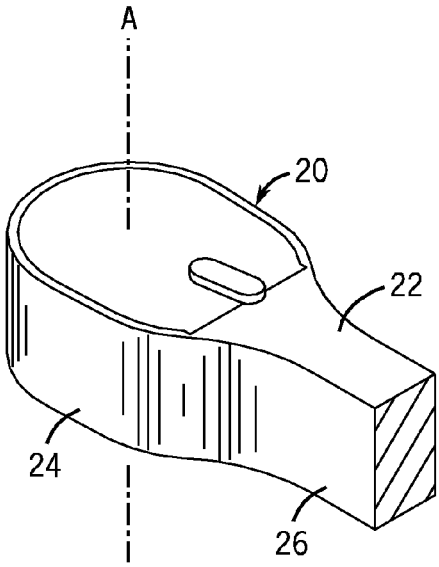
FIG. 1A is a perspective view of an exemplary ratchet tool according to the principles of the present disclosure.
Figure 1B:
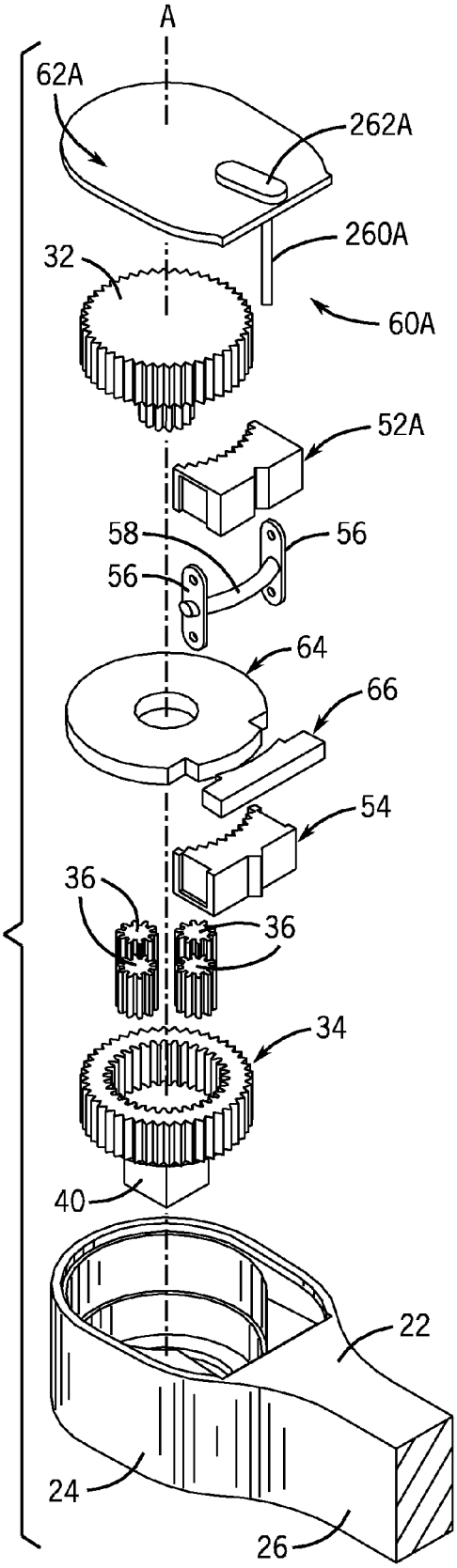
FIG. 1B is an exploded perspective view of the ratchet tool of FIG. 1A.
Figure 3:
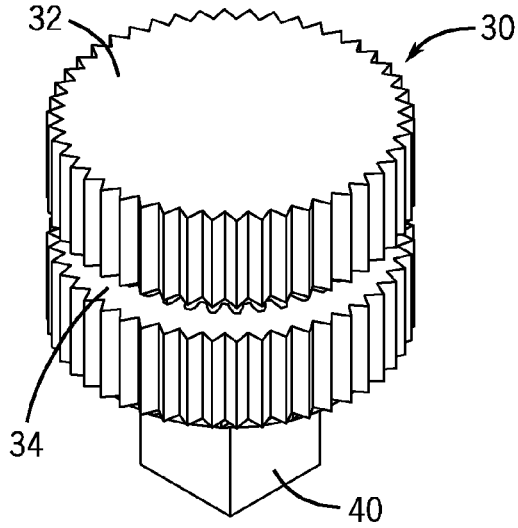
FIG. 3 is a perspective view of an exemplary gear train according to the principles of the present disclosure.

Referring to FIGS. 1A and 1B, a ratchet tool 20 according to the principles of the present disclosure is illustrated. Ratchet tool 20 includes a body 22 having a head 24 and an elongated handle 26. Head 24 houses and supports a gear train 30 (FIG. 3). Gear train 30 includes a first or top driving gear 32, a second or bottom driving gear 34, and a gear coupling in the form of a plurality of idler gears 36 disposed therebetween. Furthermore, bottom driving gear 34 supports a socket drive 40. Head 24 also houses and supports a pawl assembly 50A. Pawl assembly 50A includes a first or top pawl 52A and a second or bottom pawl 54 which are adapted to mesh with top and bottom driving gears 32, 34, respectively, as described in further detail hereinafter. Pawl assembly 50A also includes a pair of push arms 56 extending between top and bottom pawls 52A, 54 and a pivot member 58 disposed between push arms 56. A switching mechanism 60A extends into head 24 and is supported by a top cover 62A. Top cover 62A, in conjunction with head 24, encases gear train 30 and pawl assembly 50A. First and second separation plates 64, 66 are also disposed within head 24 between top and bottom driving gears 32, 34 and top and bottom pawls 52A, 54, respectively.

Additionally, an axis A is defined through head 24. It should be understood that, as used herein, the terms "axial" and "axially" refer to a direction along axis A, and that the terms "radial" or "radially" refer to a direction perpendicular to axis A.

As is described in further detail hereinafter, as handle 26 rotates about axis A, pawl assembly 50A selectively engages gear train 30 to transmit torque from body 22 to socket drive 40. More particularly, according to the principles of the present disclosure, the arrangement and interaction of body 22, gear train 30, pawl assembly 50A and switching mechanism 60A provide for transmission of torque to socket drive 40 in a single direction, independent of the direction of the rotation of handle 26 about axis A. Furthermore, according to the principles of the present disclosure, the direction of the torque transmitted at socket drive 40 is determined by the position of switching mechanism 60A.

Figure 2A:
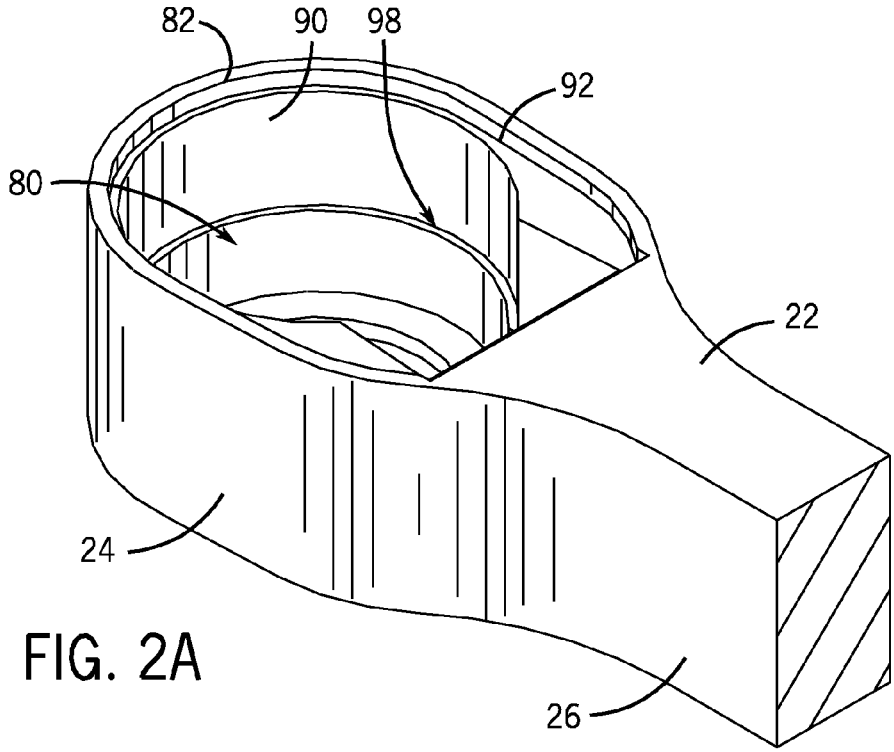
FIG. 2A is a perspective view of an exemplary head portion of a tool body according to the principles of the present disclosure.
Figure 2B:
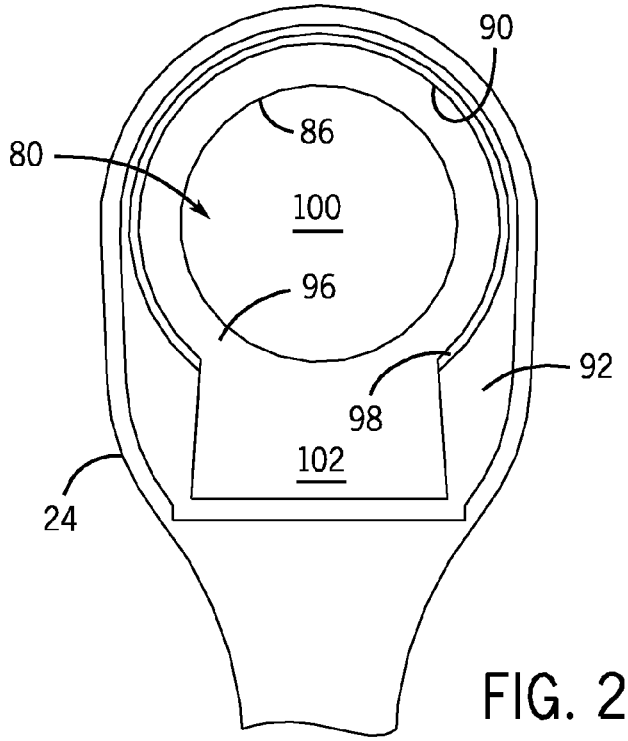
FIG. 2B is a top view of the head portion of FIG. 2A.

Referring to FIGS. 2A and 2B, head 24 is illustrated in further detail. Head 24 extends away from handle 26 in a direction along the length of handle 26. Head 24 has a generally wide and rounded shape. Furthermore, head 24 includes a cavity 80. Cavity 80 extends between a top aperture 82 of head 24 and a generally circular bottom aperture 86 of head 24. Cavity 80 is defined by an inner sidewall 90, which has a stepped configuration extending more inwardly from top aperture 82 to bottom aperture 86. In particular, inner sidewall 90 defines a top cover ledge 92 proximate top aperture 82, a cavity floor 96 proximate bottom aperture 86, and a separation plate ledge 98 disposed therebetween.

Inner sidewall 90 further defines a gear subcavity 100 and a pawl subcavity 102 of cavity 80. Gear subcavity 100 has a generally cylindrical shape corresponding to gear train 30. In particular, head 24 is configured so that bottom aperture 86, the sections of inner sidewall 90 disposed within gear subcavity 100, and the section of top aperture 82 disposed within gear subcavity 100 are substantially concentric about axis A.

Pawl subcavity 102 is disposed within cavity 80 so as to be between gear subcavity 100 and handle 26 in a direction along the length of handle 26. Pawl subcavity 102 is defined by inner sidewall 90 to extend between top cover ledge 92 and cavity floor 96. Pawl subcavity 102 has a generally box-like shape corresponding to pawl assembly 50A.

Gear train 30 and its components are illustrated in FIGS. 3-6. With particular reference to FIG. 3, gear train 30 includes a top driving gear 32 which rests upon a separation plate that is located within the gear train subcavity with socket drive 40 extending outwardly from bottom driving gear 34 opposite of top driving gear 32. Furthermore, idler gears 36 (FIG. 1B) are disposed therebetween. As described in more detail hereinafter, gear train 30 couples top and bottom driving gears 32, 34 such that rotation about axis A of one of top and bottom driving gears 32, 34 drives rotation about axis A of the other of top and bottom driving gears 32, 34 in an opposite direction.

Figure 4A:
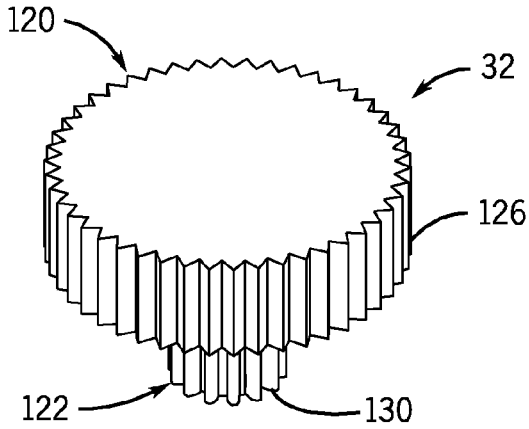
FIG. 4A is a perspective view of an exemplary top driving gear according to the principles of the present disclosure.
Figure 4B:
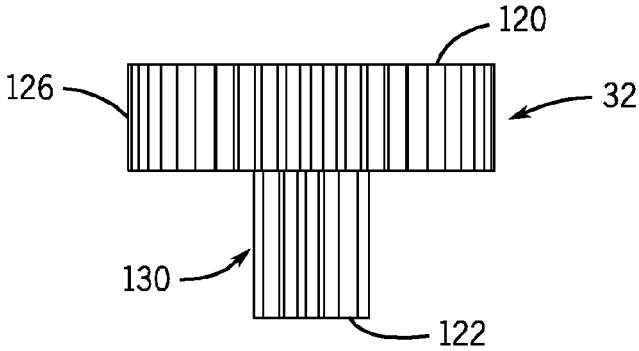
FIG. 4B is a side view of the top driving gear of FIG. 4A.

Referring to FIGS. 4A and 4B, top driving gear 32 includes an external spur gear 120 fixed to a pinion gear 122. External spur gear 120 is a generally cylindrical element having a plurality of straight teeth 126 extending outwardly therefrom. Pinion gear 122 also includes a generally cylindrical element and has a plurality of involute teeth 130 extending outwardly therefrom. Pinion gear 122 is generally smaller than spur gear 120, and spur gear 120 and pinion gear 122 are fixed together so as to be concentric.

Figure 5:
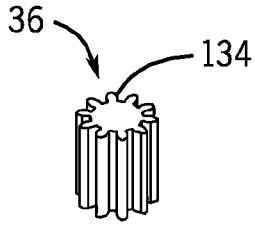
FIG. 5 is a perspective view of an exemplary idler gear according to the principles of the present disclosure.

One of idler gears 36 is illustrated in FIG. 5. Similar to the components of top driving gear 32, each of idler gears 36 is a generally cylindrical element having a plurality of involute teeth 134 extending outwardly therefrom. The diametral pitch of involute teeth 134 of idler gears 36 is consistent with the diametral pitch of involute teeth 130 of pinion gear 122. As such, idler gears 36 are configured to mesh with pinion gear 122.

Figure 6A:
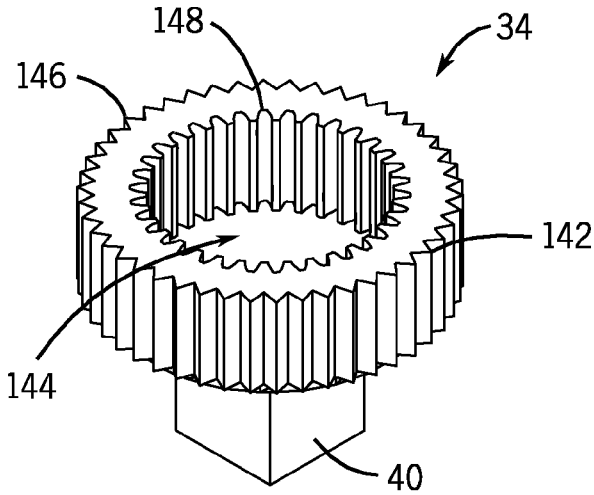
FIG. 6A is a perspective view of an exemplary bottom driving gear according to the principles of the present disclosure.
Figure 6B:
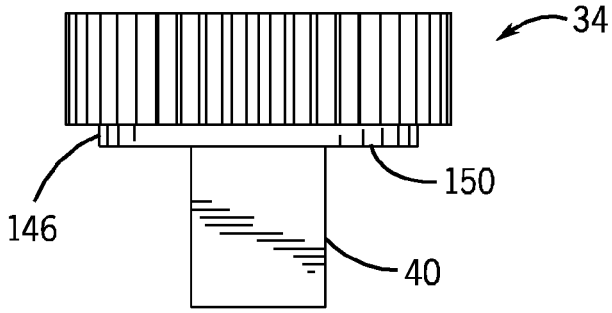
FIG. 6B is a side view of the bottom driving gear of FIG. 6A.

Referring to FIGS. 6A and 6B, bottom driving gear 34 is a generally annular element defining an outer circumferential surface 142 and an inner circumferential surface 144. Bottom driving gear 34 further includes a plurality of straight teeth 146 extending from outer circumferential surface 142, and a plurality of involute teeth 148 extending from inner circumferential surface 144. The diametral pitch of involute teeth 148 is consistent with the diametral pitch of involute teeth 134 of idler gears 36. As such, idler gears 36 are configured to mesh with bottom driving gear 34 at inner circumferential surface 144.

With continued reference to FIGS. 6A and 6B, socket drive 40 has a generally rectangular shape. Socket drive 40 is fixed to bottom driving gear 34 at an intermediate member 150. It should be understood that socket drive 40, according to the principles of the present disclosure, can have a variety of shapes and configurations according to the particular application of ratchet tool 20.

Figure 7A:
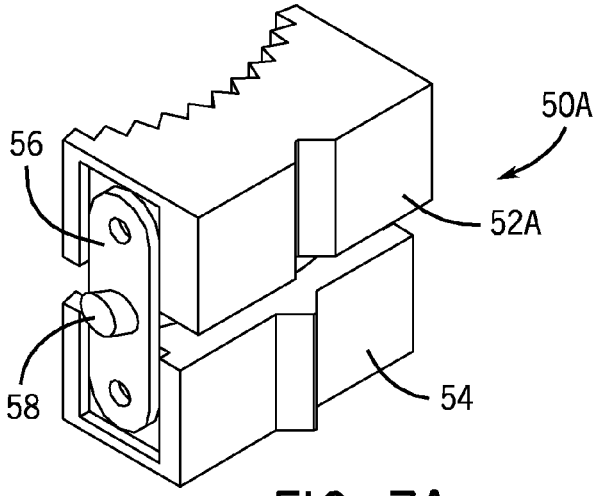
FIG. 7A is a perspective view of an exemplary pawl assembly according to the principles of the present disclosure.
Figure 7B:
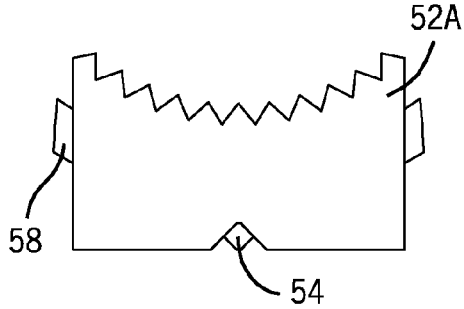
FIG. 7B is a top view of the pawl assembly of FIG. 7A.

Pawl assembly 50A and its components are illustrated in FIGS. 7-11. With particular reference to FIG. 7, top pawl 52A rests on first and second separation plates that are located within the gear train and pawl assembly subcavities. Furthermore, top and bottom pawls 52A, 54 are coupled together by push arms 56, as described in more detail hereinafter. According to the principles of the present disclosure, top and bottom pawls 52A, 54 have relatively greater strength and smaller ratcheting steps as compared to traditional pawls.

More particularly, the exemplary, illustrated design provides greater strength as compared to conventional ratchet wrenches due to the increased surface area between the pawl teeth and driving gear teeth. For example, while conventional ratchet wrenches typically have two to three pawl teeth in contact with the driving gear, the exemplary, illustrated design provides ten teeth in contact between the driving gears and the pawls. The face width of the outer circumferential surfaces of the top driving gear and the bottom driving gear of the exemplary, illustrated design is half that of a conventional ratchet wrench. As will be understood, because the ratio of the number of teeth in contact in the exemplary, illustrated design, to the number of teeth in contact in a conventional ratchet wrench design is greater than two, the exemplary, illustrated design provides greater strength relative to the aforementioned conventional ratchet wrench design. Furthermore, the exemplary, illustrated design provides smaller ratcheting steps as compared to conventional ratchet wrenches due to the provision of a relatively smaller swing arc. In this regard, a conventional ratchet wrench typically has a swing arc greater than or equal to five degrees whereas the illustrated, exemplary ratchet wrench has a ratchet step of four degrees which is achieved by providing the driving gear with 46 teeth and a diameter of one inch. It will be additionally understood that a ratchet step of less than four degrees can be achieved if a driving gear with seventy-two teeth is utilized. Yet further, it will be understood that the ratchet step can be reduced by utilizing stub teeth as compared to the full depth teeth illustrated.

Figure 8A:
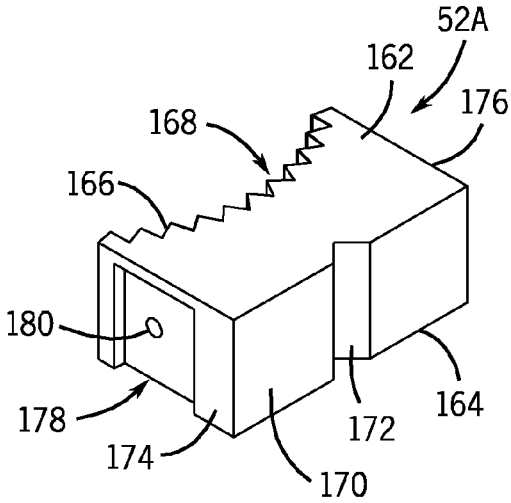
FIG. 8A is a perspective view of an exemplary top pawl according to the principles of the present disclosure.
Figure 8B:
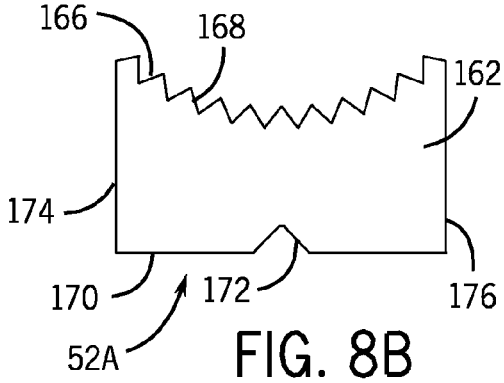
FIG. 8B is a top view of the top pawl of FIG. 8A.

Referring to FIGS. 8A and 8B, top pawl 52A is a generally rectangular element defining a top side 162 and a bottom side 164. Top pawl 52A also defines a concave engaging side 166 shaped complementary to top driving gear 32 and having a plurality of teeth 168 extending outwardly therefrom. Teeth 168 are configured to be inverse to teeth 126 extending from spur gear 120 of top driving gear 32. As such, top pawl 52A is configured to mesh with spur gear 120 and, thus, selectively drive the rotation of top driving gear 32 about axis A.

Top pawl 52A further defines a switching side 170 opposite engaging side 166. Switching side 170 includes a notch 172 defined therein which extends between top and bottom sides 162, 164. Notch 172 is disposed in a generally central position on switching side 170.

First and second ends 174, 176 are also defined by top pawl 52A. First end 174 has a recessed portion 178 defined therein, which extends to the intersection between first end 174 and bottom side 164. Furthermore, a hole 180 is disposed within recessed portion 178. Second end 176 has a similarly positioned recessed portion (not shown) defined therein and a hole (not shown) located within the recessed portion that has a position corresponding to hole 180.

Figure 9A:
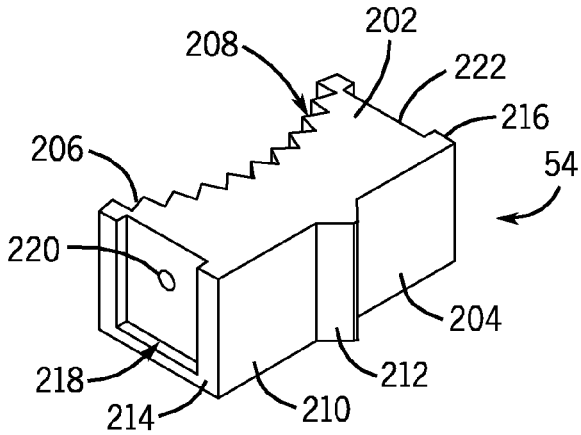
FIG. 9A is a perspective view of an exemplary bottom pawl according to the principles of the present disclosure.
Figure 9B:
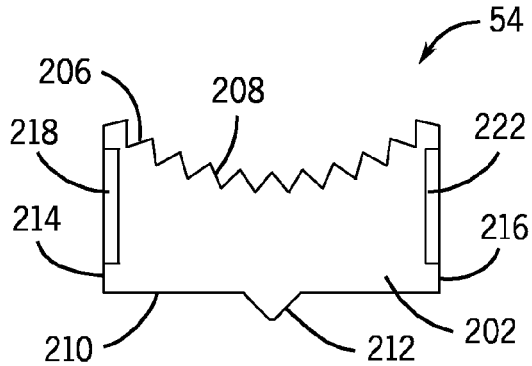
FIG. 9B is a top view of the bottom pawl of FIG. 9A.

Referring to FIGS. 9A and 9B, bottom pawl 54 is a generally rectangular element defining a top side 202 and a bottom side 204. Bottom pawl 54 further defines a concave engaging side 206 complementary to outer circumferential surface 142 of bottom driving gear 34. More particularly, a plurality of teeth 208 extend outwardly from engaging side 206, and teeth 208 are configured to be inverse to teeth 146 extending from outer circumferential surface 142 of bottom driving gear 34. As such, bottom pawl 54 is configured to mesh with outer circumferential surface 142 and, thus, selectively drive the rotation of bottom driving gear 34 about axis A.

Bottom pawl 54 further defines a switching side 210 opposite engaging side 206. Switching side 210 includes a protrusion 212 extending outwardly therefrom, which extends between top and bottom sides 202, 204. Protrusion 212 is disposed in a generally central position on switching side 210 so as to correspond with notch 172 of top pawl 52A.

First and second ends 214, 216 are also defined by bottom pawl 54. First end 214 has a recessed portion 218 defined therein, which extends to the intersection between first end 214 and top side 202. Furthermore, a hole 220 is disposed within recessed portion 218. Similarly, second end 216 has a recessed portion 222 defined therein, which extends to the intersection between second end 216 and top side 202. A hole (not shown) is disposed within recessed portion 222 and has a position corresponding to hole 220.

Figure 10:
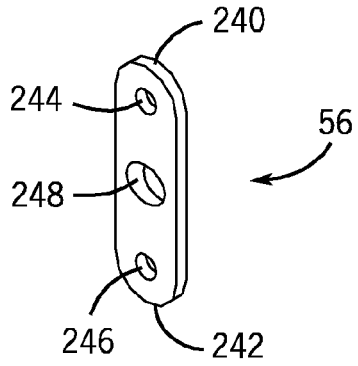
FIG. 10 is a perspective view of an exemplary push arm according to the principles of the present disclosure.
Figure 11:
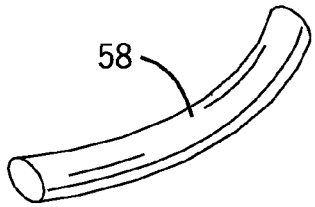
FIG. 11 is a perspective view of an exemplary pivot member according to the principles of the present disclosure.

An exemplary one of push arms 56 is illustrated in FIG. 10. It should be understood that the description of a single push arm 56 applies equally to all push arms 56. Exemplary push arm 56 has a generally elongated and thin rectangular shape having rounded corners. In particular, push arm 56 extends between a rounded top end 240 and a rounded bottom end 242. Proximate top end 240 is a top connection aperture 244, and proximate bottom end 242 is a bottom connection aperture 246. A center aperture 248 configured to engaged pivot member 58 is disposed between top and bottom connection apertures 242, 244. With reference to FIG. 11, pivot member 58 is generally cylindrical element with a curved shape complimentary to gear train 30 and positioned substantially concentric about axis A.

Figure 12:
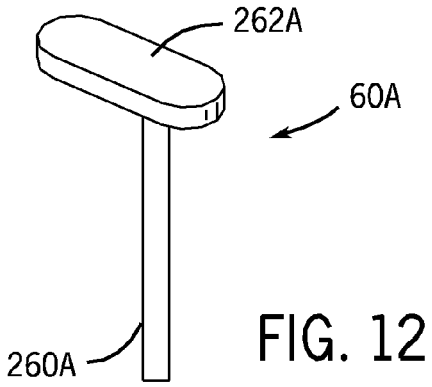
FIG. 12 is a perspective view of an exemplary switching mechanism according to the principles of the present disclosure.
Figure 13:
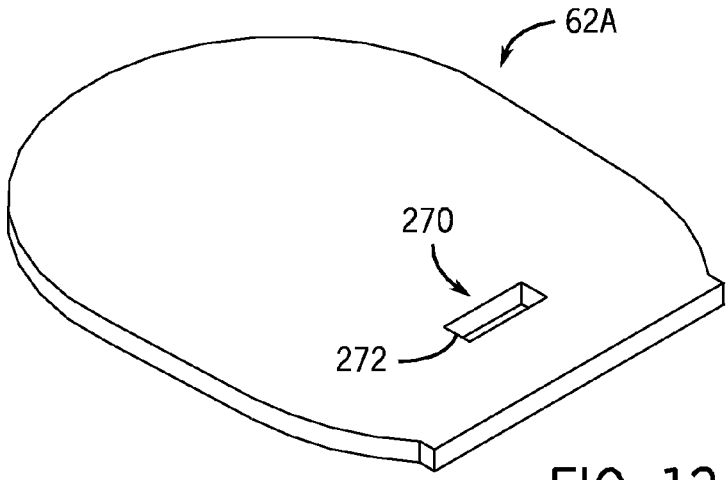
FIG. 13 is a perspective view of an exemplary top cover according to the principles of the present disclosure.

Referring to FIG. 12, switching mechanism 60A is illustrated in detail. Switching mechanism 60A includes an elongate arm 260A having a rectangular cross section complementary to notch 172 of top pawl 52A and protrusion 212 of bottom pawl 54. Arm 260A is fixed to a base element 262A. As shown in FIG. 1B, top cover 62A supports switching mechanism 60A. With reference to FIG. 13, top cover 62A has a generally flat shape complementary to aperture 82 and top cover ledge 92 of head 24. Top cover 62A supports switching mechanism 60A at a switch pivot point 270. Top cover 62A also includes an aperture 272 through which arm 260A of switching mechanism 60A extends.

Figure 14:
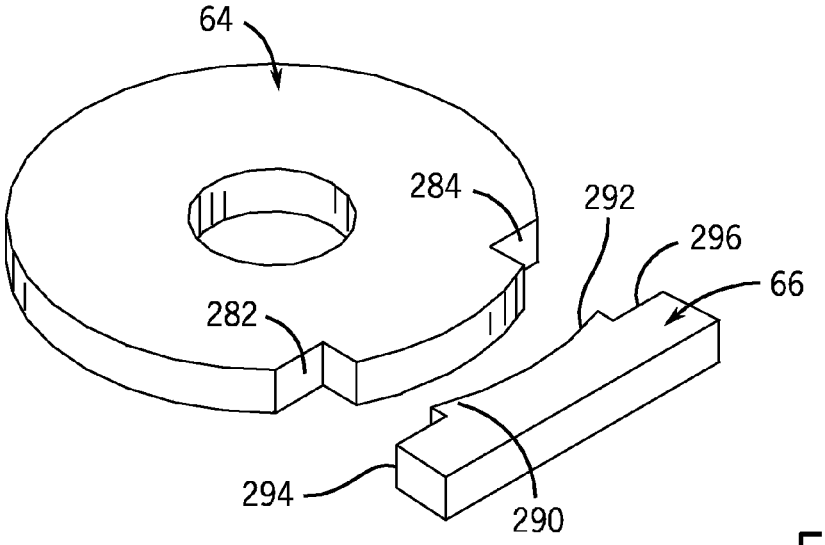
FIG. 14 is a perspective view of an exemplary pair of separation plates according to the principles of the present disclosure.

First and second separation plates 64, 66 are illustrated in FIG. 14. First separation plate 64 has a generally flat ring shape defining a center aperture shaped so as to correspond with pinion gear 122 of top driving gear 32. First separation plate 64 includes a pair of notches 282, 284 which allow for pawl assembly 50A as described in more detail herein. Second separation plate 66 has a generally rectangular shape with a protrusion 290 extending therefrom. Protrusion 290 defines a concave surface 292 complementary to first separation plate 64. Protrusion 290 is disposed on second separation plate 66 so that a pair of spaces 294, 296 are defined on either side thereof to correspond with notches 282, 284 of first separation plate 64.

Referring again to FIG. 1B, the assembly of ratchet tool 20 includes bottom driving gear 34 being inserted into head 24. More specifically, bottom driving gear 34 is disposed within gear subcavity 100 of cavity 80 and oriented such that socket drive 40 extends through bottom aperture 86 and outside of head 24. Bottom driving gear 34 sits on and is supported by cavity floor 96. Furthermore, idler gears 36 are disposed within inner circumferential surface 144 of bottom driving gear 34. In particular, idler gears 36 are spaced apart so that teeth 134 each mesh with teeth 148 of inner circumferential surface 144.

With bottom driving gear 34 and idler gears 36 in place, pawl assembly 50A and first and second separation plates 64, 66 are installed. Pawl assembly 50A is assembled by first coupling pivot member 58 between push arms 56 at center apertures 248. Push arms 56 are coupled to top and bottom pawls 52A, 54 by top apertures 244 and bottom apertures 246 being rotatably coupled to holes of top pawl 52A and holes of bottom pawl 54, respectively. First separation plate 64 is disposed over bottom driving gear 34 and engages separation plate ledge 98. Second separation plate 66 is disposed within pawl subcavity 102 of cavity 80. Moreover, each of first and second separation plates 64, 66 extend, at least in part, between top and bottom pawls 52A, 54. Therefore, for example, one of first and second separation plates 64, 66 can be installed before pawl assembly 50A, pawl assembly 50A can be installed with the separation plate disposed between top and bottom pawls 52A, 54, and then the other of the separation plates can be installed. However, it should be understood that a variety of methods of assembly can provide for such a configuration.

Next, top driving gear 32 is positioned on first separation plate 64 with pinion gear 122 extending through a center aperture and between idler gears 36. Pinion gear 122 meshes with idler gears 36, thus coupling top driving gear 32 and bottom driving gear 34. Additionally, external spur gear 120 is aligned with top pawl 52A.

Finally, switching mechanism 60A and top cover 62A are installed. In particular, arm 260A of switching mechanism 60A is disposed proximate switching sides 170, 210 of top and bottom pawls 52A, 54. Top cover 62A extends over the entirety of cavity 80 and is supported by top cover ledge 92.

Figure 17A:
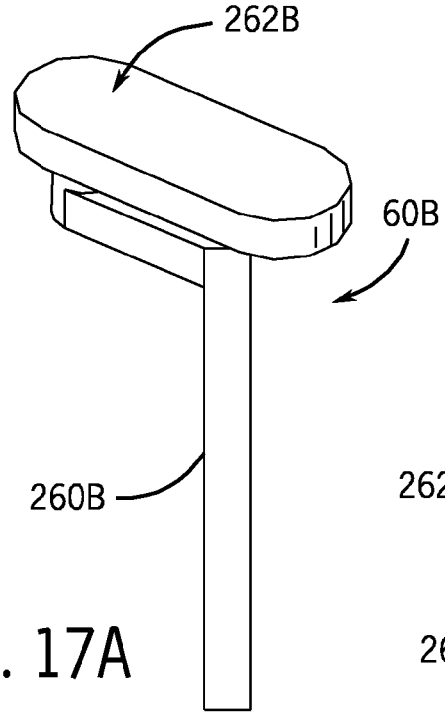
FIG. 17A is a perspective view of an exemplary switching mechanism according to the principles of the present disclosure.
Figure 17B:
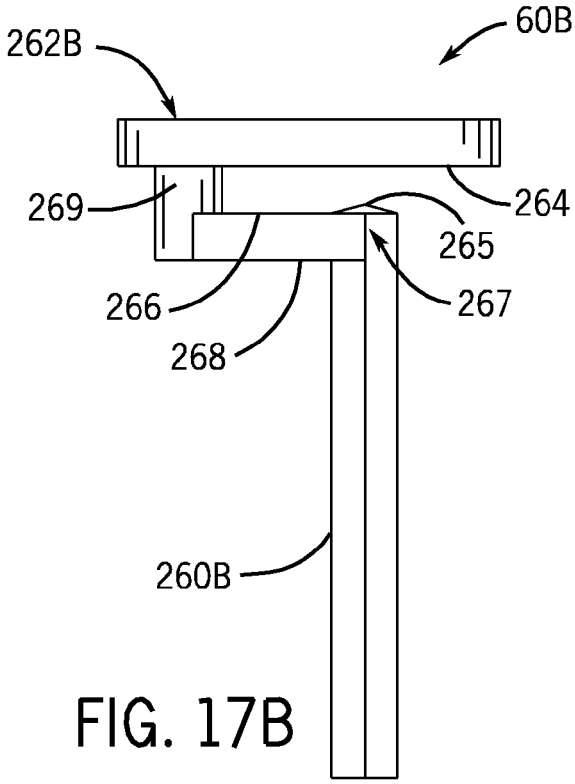
FIG. 17B is a side view of the switching mechanism of FIG. 17A.

In an alternate embodiment, the need for aperture 272 in the top cover 62A may be eliminated through alternate designs of the switching mechanism 60A, the top pawl 52A, and the top cover 62A. FIGS. 17A and 17B illustrate perspective and side views respectively for an alternate design of a switching mechanism 60B, in accordance with an embodiment. In contrast with switching mechanism 60A, switching mechanism 60B includes a gap 265 provided between the base element 262B and arm 260B. The gap 265 is defined by surface 264 and surface 266, and is wide enough to accommodate the top cover 62B. Base element 262B and arm 260B may be separated and reattached at connection point 269.

Figure 15A:
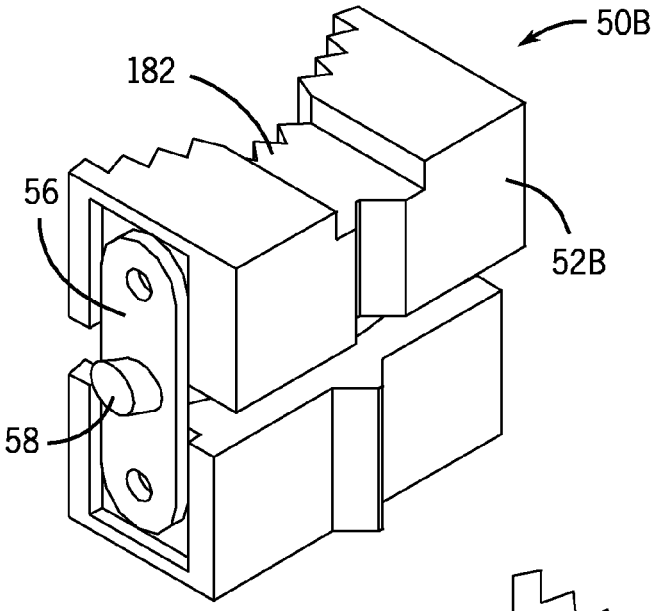
FIG. 15A is a perspective view of an exemplary pawl assembly according to the principles of the present disclosure.
Figure 15B:
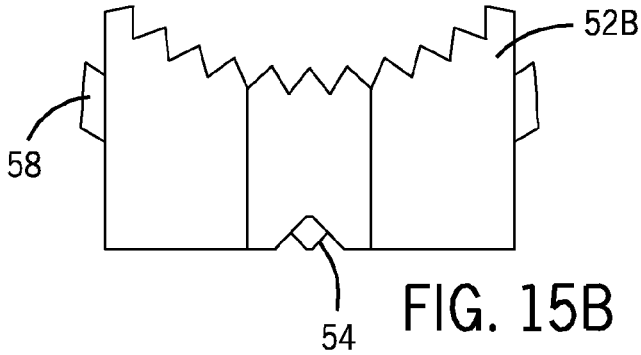
FIG. 15B is a top view of the pawl assembly of FIG. 15A.
Figure 16A:
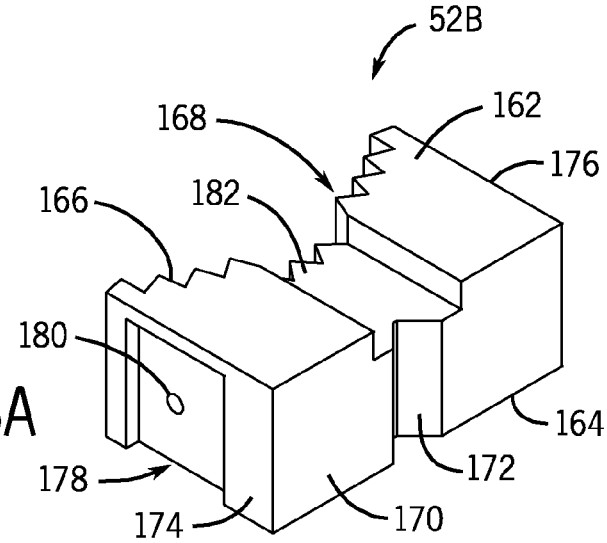
FIG. 16A is a perspective view of an exemplary top pawl according to the principles of the present disclosure.
Figure 16B:
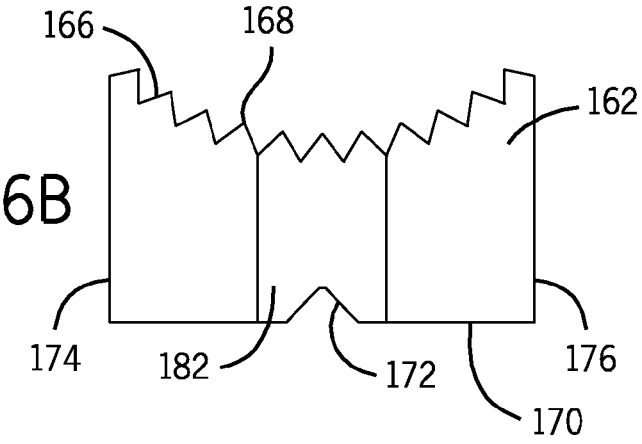
FIG. 16B is a top view of the top pawl of FIG. 16A.

FIGS. 15A and 15B illustrate perspective and top views respectively for an alternate design of a pawl assembly 50B, and FIGS. 16A and 16B illustrate perspective and top views respectively for an alternate design of a top pawl 52B, in accordance with an embodiment. As illustrated in FIGS. 15A-16B, top pawl 52B is similar to top pawl 52A in most aspects, except for the inclusion of recess 182. In one embodiment, the upward-facing surface of recess 182 is designed to accommodate surface 268 of switching mechanism 60B such that, when assembled, surface 266 lies in substantially the same plane as the top surface of the top pawl 52B.

Figure 18A:
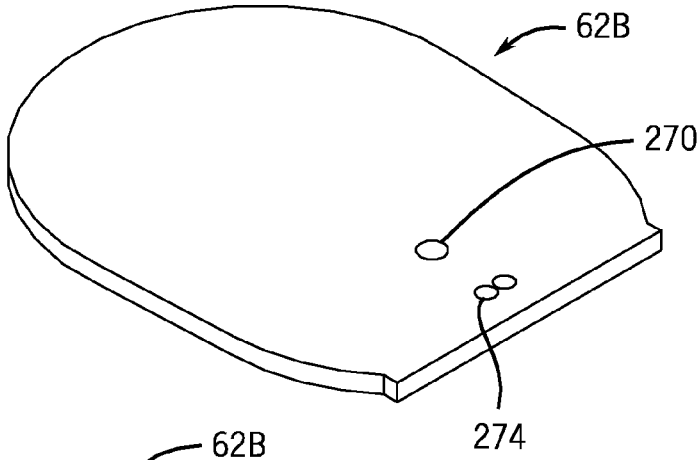
FIG. 18A is a perspective view of an exemplary top cover according to the principles of the present disclosure.
Figure 18B:
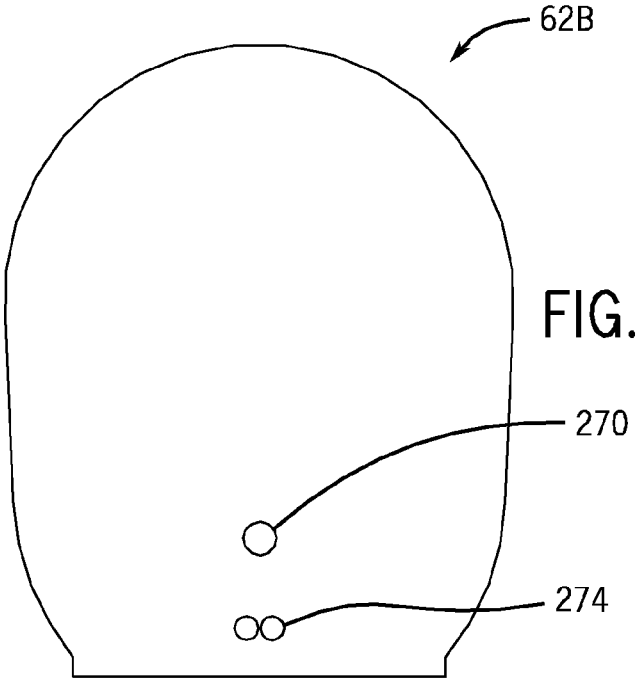
FIG. 18B is a top view of the top cover of FIG. 18A.

FIGS. 18A and 18B illustrate perspective and bottom views respectively for an alternate design of a top cover 62B, in accordance with an embodiment. As shown in FIGS. 18A and 18B, top cover 62B includes a switch pivot point 270. In one embodiment, the diameter of switch pivot point is large enough to accommodate connection point 269 of switching mechanism 60B. The top cover 62B also includes two recessed channels 274, corresponding to first and second switch positions respectively.

Figure 19:
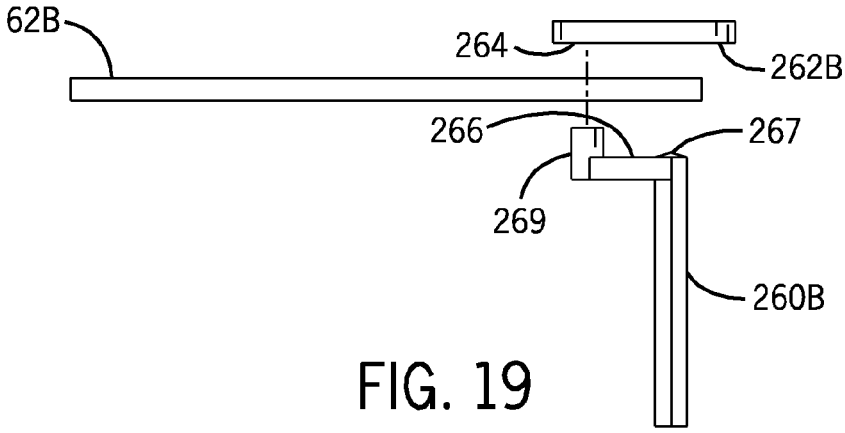
FIG. 19 is an exploded side view of a cover-switch assembly comprised of the switching mechanism of FIG. 17A and the top cover of FIG. 18A.

FIG. 19 is an exploded side view of the top cover 62B and the base element 262B and arm 260B of the switching mechanism 60B. As shown, surface 266 includes a small protrusion 267, which is complementary in size to the recessed channels 274. The size of protrusion 267 in FIGS. 17B and 19 has been exaggerated for illustration purposes. When assembled, surface 264 is substantially flush with the top surface of the top cover 62B, and surface 266 is substantially flush with the bottom surface of the top cover 62B. During operation, which is described in detail below, switching mechanism pivots at connection point 269 and pivot point 270, which are substantially concentric. Protrusion 267 is small enough to permit toggling of switching mechanism 60B between a first position and a second position, but large enough to provide sufficient friction, together with recessed channels 274, to prevent switching mechanism 60B from moving unintentionally.

Figure 20A:
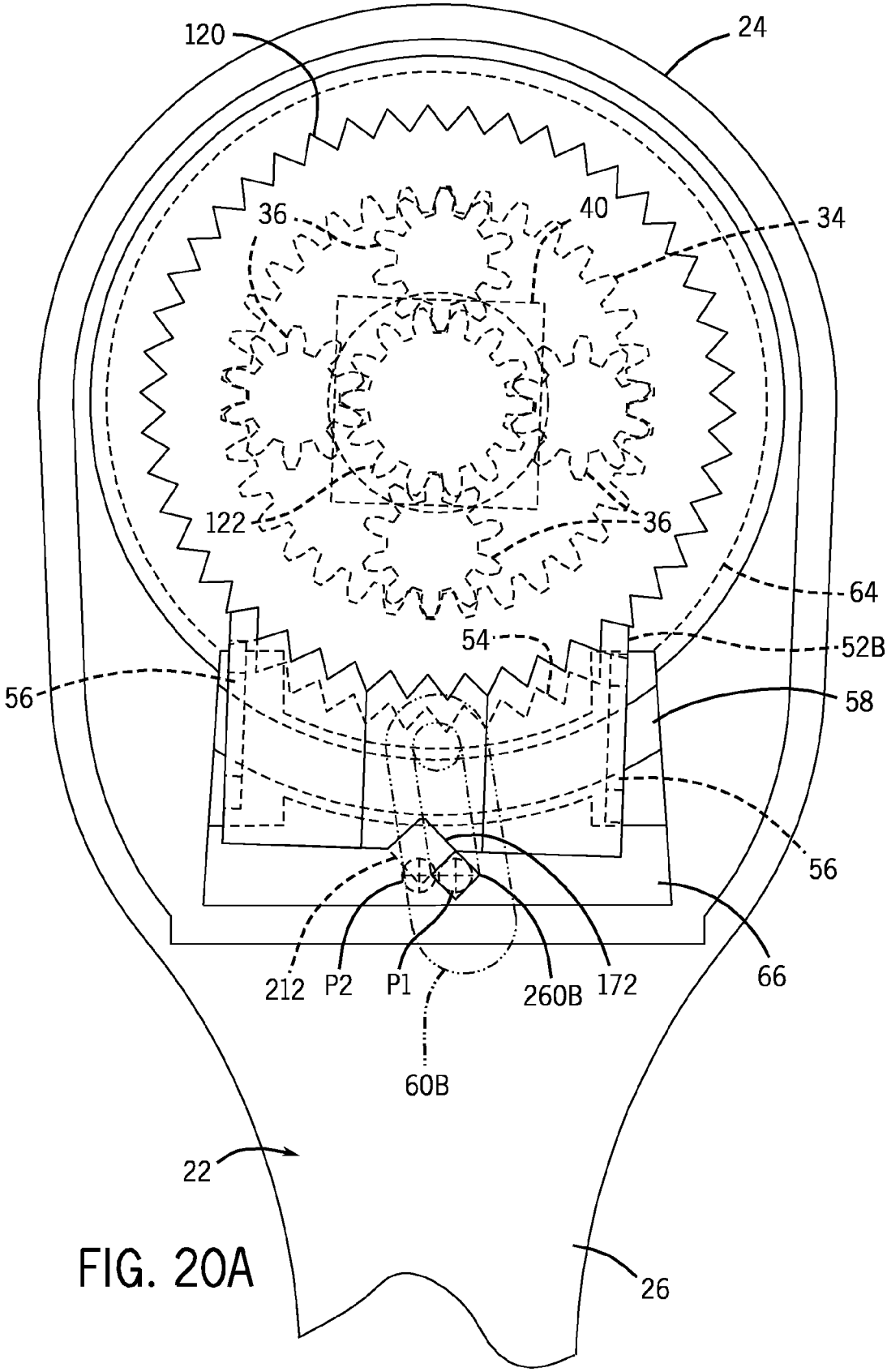
FIG. 20A is a top view of an exemplary ratchet tool, having a fully engaged top pawl and a fully disengaged bottom pawl, according to the principles of the present disclosure, with overlapping illustration of the various exemplary components.
Figure 20B:
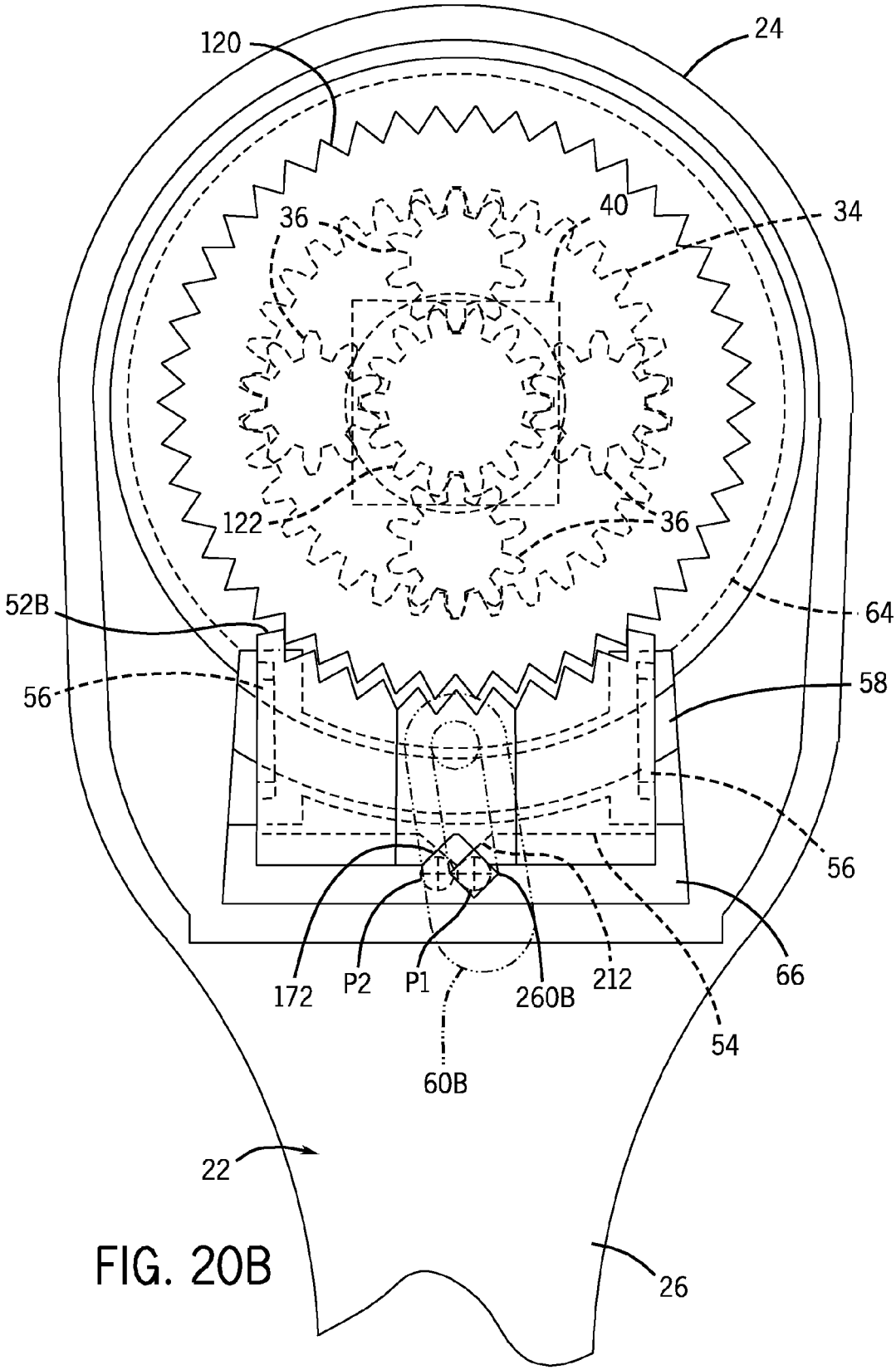
FIG. 20B is a top view of an exemplary ratchet tool, having partially engaged top and bottom pawls, according to the principles of the present disclosure, with overlapping illustration of the various exemplary components.

According to the principles of the present disclosure, ratchet tool 20 operates to provide a single direction of torque at socket drive 40 about axis A in response to either direction of rotation of handle 26 about axis A. With reference to FIGS. 20A and 20B, a representative example of the operation of ratchet tool 20 will be described herein. It should be understood that the relative terms "clockwise" and "counterclockwise" refer to the directions seen while looking down onto the top cover of the ratchet tool 20, as illustrated in FIGS. 20A and 20B.

The direction of the torque at socket drive 40 can be selected with switching mechanism 60A. As illustrated in FIG. 20A, switching mechanism 60A is in a first position, indicated at arrow P1, corresponding to a transmission of torque at socket drive 40 in the clockwise direction. Top driving gear 32 and top pawl 52A begin with teeth 126 and teeth 168 engaged, while bottom driving gear 34 and bottom pawl 54 are disengaged.

When handle 26 is rotated counterclockwise, torque is transmitted to top driving gear 32 through head 24 and top pawl 52A, thus rotating top driving gear 32 counterclockwise. The counterclockwise rotation of top driving gear 32 rotates idler gears 36 in the clockwise direction. The clockwise rotation of idler gears 36 in turn rotates bottom driving gear 34 in the clockwise direction. As socket drive 40 is rigidly affixed to bottom driving gear 34, the clockwise rotation of bottom driving gear 34 results in clockwise torque at socket drive 40.

As shown in FIG. 20B, when handle 26 switches rotation directions and is rotated clockwise, pawl assembly 50A functions to disengage top pawl 52A from top driving gear 32 and to engage bottom pawl 54 with bottom driving gear 34. In particular, because switching mechanism 60A is fixed in the first position relative to body 22, arm 260A rotates clockwise about axis A when handle 26 is rotated clockwise. Moreover, as arm 260A rotates clockwise, it applies a force to protrusion 212 on bottom pawl 54, and bottom pawl 54 moves radially toward bottom driving gear 34. More particularly, the top driving gear 32 and top pawl 52A are partially engaged during the bottom driving gear/bottom pawl engagement process. Because the top and bottom pawls are connected by means of the push arms 56 and because the teeth of the top driving gear 32 and top pawl 52A are interlocked, both top and bottom pawls are restrained from moving in a direction perpendicular to the length of the handle. Still further, because the pawls are restrained in this direction the bottom pawl will slip along the plane of the switch arm in contact with the bottom pawl, thus moving toward the bottom driving gear. As bottom pawl 54 moves radially toward bottom driving gear 34, push arms 56 rotate about pivot member 58 and, thus, moves top pawl 52A radially away from top driving gear 32, disengaging top pawl 52A and top driving gear 32.

When bottom pawl 54 and bottom driving gear 34 are relatively positioned with teeth 208 and teeth 146 fully engaged (not shown) and handle 26 is rotated clockwise, torque is transmitted to bottom driving gear 34 through head 24 and bottom pawl 54, thus rotating bottom driving gear 34 clockwise. Since socket drive 40 is rigidly affixed to bottom driving gear 34, the clockwise rotation of bottom driving gear 34 results in clockwise torque at socket drive 40.

Additionally, during this clockwise rotation of handle 26, the rotation of bottom driving gear 34 rotates idler gears clockwise, which in turn rotates top driving gear 32 counterclockwise. However, top driving gear 32 is free to rotate since top pawl 52A is disengaged. Therefore, the counterclockwise rotation of top driving gear 32 is incidental.

If handle 26 again switches rotation directions and, thus, again is rotated counterclockwise, pawl assembly 50A functions to engage top pawl 52A and top driving gear 32 while contemporaneously disengaging bottom pawl 54 and bottom driving gear 34. In particular, arm 260A of switching mechanism 60A interacts with notch 172 of top pawl 52A so as to cause top pawl 52A to move radially toward top driving gear 32. The remainder of the operation is otherwise similar, yet inverse, to the engagement/disengagement described above.

Accordingly, both counterclockwise and clockwise rotation of handle 26 about axis A provide clockwise torque at socket drive 40 with switching mechanism 60A in the first position.

Additionally, it should be understood that, at a second position of switching mechanism 60A, indicated by the dot at arrow P2 in FIG. 20A, both counterclockwise and clockwise rotation of handle 26 about axis A provide for transmission of torque at socket drive 40 the opposite direction (in this case, in the counterclockwise direction). For example, the second position of switching mechanism 60A is opposite the first position with respect to notch 172 and protrusion 212. As such, with switching mechanism 60A in the second position, clockwise rotation of handle 26 provides for engagement of top pawl 52A and top driving gear 32 and, thus, counterclockwise torque at socket drive 40. Counterclockwise rotation of handle 26 causes top pawl 52A to disengage top driving gear 32 and bottom pawl 54 to engage and drive bottom driving gear 34, also resulting in counterclockwise torque at socket drive 40.

Accordingly, it should be understood that the operation of ratchet tool 20 with switching mechanism 60A in the second position is generally similar to the operation described above with switching mechanism 60A in the first position.

The present disclosure can vary in many ways. For example, the teeth on the various gears can vary in shape and number. Furthermore, the shape and configuration of the various components, such as the handle and socket drive, by way of non-limiting example, can vary. Additionally, it should be understood that the assembly and use of the ratchet tool provided herein is exemplary and can vary and, as such, it is to be understood that the present disclosure is merely exemplary in nature.

What is claimed is:

1. A ratchet tool comprising:

a body including a head and a handle, said head having a cavity formed therein, said head further having an axis defined therethrough, said handle having an end fixed relative to said head, said handle defining a length extending away from said head, said handle being oriented with said length substantially perpendicular to said axis;

a gear train disposed within said cavity, said gear train including first and second gears pivotally supported about said axis and a gear coupling disposed between said first and second gears, said gear coupling transmitting rotation of one of said first and second gears to an opposite rotation of the other of said first and second gears;

a socket drive fixed relative to said second gear and extending outside of said head;

a pawl assembly disposed within said cavity outside of said gear train, said pawl assembly including a first pawl adapted to mesh with said first gear and a second pawl adapted to mesh with said second gear, said pawl assembly further including a pivot member and a pair of push arms disposed between said first and second pawls, said push arms pivotally coupling said first and second pawls about said pivot member, said pawl assembly being movable between first and second configurations, said first configuration including said first pawl pivoted into engagement with said first gear and said second pawl correspondingly pivoted away from said second gear, said second configuration including said second pawl pivoted into engagement with said second gear and said first pawl correspondingly pivoted away from said first gear; and a switching mechanism extending into said cavity and engaging said pawl assembly, said switching mechanism being selectively fixed in a first position relative to said body, said switching mechanism applying a first force to said pawl assembly to move said pawl assembly to said first configuration when said handle is rotated about said axis in a first direction, said switching mechanism applying a second force to said pawl assembly to move said pawl assembly to said second configuration when said handle is rotated about said axis in a second direction opposite to said first direction.

2. The ratchet tool of claim 1, wherein said first gear has a spur gear portion and a pinion gear portion, said spur gear portion being larger than said pinion gear portion, said spur gear portion including a plurality of teeth extending outwardly therefrom, said pinion gear portion including a plurality of teeth extending outwardly therefrom.

3. The ratchet tool of claim 2, wherein said first pawl defines a concave engaging side having a plurality of teeth extending therefrom, said teeth of said concave engaging side being complementary to said teeth of said spur gear portion.

4. The ratchet tool of claim 3, wherein said teeth of said spur gear portion and said teeth of said concave engaging side are straight in shape.

5. The ratchet tool of claim 2, wherein said second gear has a generally annular shape and defines an outer circumferential surface and an inner circumferential surface, said outer circumferential surface having a plurality of teeth extending outwardly therefrom, said inner circumferential surface having a plurality of teeth extending inwardly therefrom.

6. The ratchet tool of claim 5, wherein said second pawl defines a concave engaging side having a plurality of teeth extending outwardly therefrom, said teeth of said concave engaging side being complementary to said teeth of said outer circumferential surface.

7. The ratchet tool of claim 6, wherein said teeth of said outer circumferential surface and said teeth of said concave engaging side are straight in shape.

8. The ratchet tool of claim 5, wherein gear coupling includes a plurality of idler gears, said idler gears each having a plurality of teeth extending outwardly therefrom complementary to said teeth of said pinion gear portion and said teeth of said inner circumferential surface.

9. The ratchet tool of claim 8, wherein said idler gears are disposed within and engaged with said inner circumferential surface of said second gear, said idler gears being spaced apart from each other, said pinion gear portion extending between and engaging said idler gears.

10. The ratchet tool of claim 8, wherein said teeth of said idler gears, said teeth of said pinion gear portion, and said teeth of said inner circumferential surfaces are involute in shape.

11. The ratchet tool of claim 5, wherein said spur gear portion of said first gear is substantially similar in size to said outer circumferential surface of said second gear.

12. The ratchet tool of claim 1, wherein each of said first and second pawls define a concave gear engaging side and a switching side opposite said concave gear engaging side, said switching side of said first pawl having a notch defined therein at a generally central portion thereof, said switching side of said second pawl having a protrusion extending therefrom at a generally central portion thereof corresponding with said notch of said first pawl.

13. The ratchet tool of claim 12, wherein said switching mechanism includes an elongate switch arm engaging said switching sides of said first and second pawls proximate said notch and said protrusion.

14. The ratchet tool of claim 13, wherein said elongate switch arm has a substantially rectangular cross section, said notch defining a substantially square corner complementary to said elongate switch arm, said protrusion defining a substantially square corner complementary to said elongate switch arm.

15. The ratchet tool of claim 1, further comprising a pair of separation plates disposed within said cavity between said first and second gears and between said first and second pawls.

16. The ratchet tool of claim 1, further comprising a top cover supporting said switching mechanism, said top cover extending over said cavity and engaging said head.

17. The ratchet tool of claim 1, wherein said switching mechanism is selectively fixed in a second position relative to said body, said switching mechanism applying a third force to said pawl assembly to move said pawl assembly to said second configuration when said handle is rotated about said axis in said first direction, said switching mechanism applying a fourth force to said pawl assembly to move said pawl assembly to said first configuration when said handle is rotated about said axis in said second direction.

* * * * *